United States Patent [19]

Endoh et al.

[11] Patent Number: 4,661,151

[45] Date of Patent: Apr. 28, 1987

[54] TREATING AGENT FOR DESULFURIZING MOLTEN STEELS AND METHOD FOR TREATING MOLTEN STEELS

[75] Inventors: Koichi Endoh; Toshiyuki Kaneko; Hideo Yaoi; Seiji Aso; Yasuo Obana; Hideyuki Takahama, all of Oita, Japan

[73] Assignee: Nippon Steel Corporation, Tokyo, Japan

[21] Appl. No.: 835,554

[22] Filed: Mar. 3, 1986

[30] Foreign Application Priority Data

Mar. 4, 1985 [JP] Japan ..... 6041018
Mar. 29, 1985 [JP] Japan ..... 6063896

[51] Int. Cl.[4] ..... C21C 7/02

[52] U.S. Cl. ..... 75/53; 75/58; 75/257

[58] Field of Search ..... 75/53, 58, 257; 148/26

[56] References Cited

U.S. PATENT DOCUMENTS 3,201,292 8/1965 Miltschitzky ..... 148/26
3,309,194 3/1967 Dunn ..... 75/58
4,097,269 6/1978 Holzgruber ..... 75/58
4,391,633 7/1983 Yamanchi ..... 75/58

FOREIGN PATENT DOCUMENTS 979583 1/1965 United Kingdom ..... 75/10 R

*Primary Examiner*—Peter D. Rosenberg
*Attorney, Agent, or Firm*—Kenyon & Kenyon

[57] ABSTRACT

A treating agent of molten steel according to the present invention is used for desulfurization molten steel for desulfurizing it in a reaction vessel which is lined with a basic refractory containing MgO, and consists of CaO, $CaF_2$ and MgO and unavoidable impurities contains from 10 to 60% by weight of MgO, and has a weight ratio of $\{(\%\ CaF_2)/((\%\ CaO)+(\%\ CaF_2))\}\times 100(\%)$ of from 20 to 80%.

Said agent is injected with the aid of inert carrier gas into the molten steel and floats toward a portion of the molten steel bath essentially free of slag. Another treating agent essentially consisting of CaO and $CaF_2$ may be also injected prior and/or subsequent to injection of said agent, so as to decrease inclusions. The inert gas may also be injected after injection of said agent(s).

4 Claims, 10 Drawing Figures

TREATING AGENT FOR DESULFURIZING MOLTEN STEELS AND METHOD FOR TREATING MOLTEN STEELS

BACKGROUND OF THE INVENTION

1. Field of the Invention

The present invention relates to a treating agent used for desulfurizing molten steel in a reaction vessel having a lining of MgO-containing basic refractory, and to a method for desulfurizing the molten steel in such a vessel. The present invention also relates to a method for decreasing inclusions in the molten steel. The present invention proposes a treating agent and desulfurizing method which attains an effective desulfurization while preventing erosion of the reaction vessel. The present invention also proposes an effective method for decreasing the above-mentioned inclusions.

2. Description of the Related Art

Recently, strict requirements are demanded for the requisite properties of steel materials. Such strict demands are particularly concentrated upon the pipe line materials, which must have anti-hydrogen-induced cracking characteristics, and upon the materials used for ocean structures, which must have anti-lamelar tear characteristics. To meet such demands, it is essential to reduce the content of sulfur (hereinafter referred to as "S") in molten steel as low a level as possible. In addition, gaseous components, i.e., nitrogen (hereinafter referred to as "N") and hydrogen (hereinafter referred to as "H") as well as oxide-based inclusions must be decreased.

Desulfurizing methods are roughly classified into those for desulfurizing molten pig iron and those for desulfurizing molten steel. The former is performed during treatment of the molten pig iron, and the latter is performed during or after refining the molten pig iron into molten steel. In order to melt steels having an ultra-low S concentration, these methods must be combined.

It is common practice in the desulfurization of molten steel to inject a mixture of CaO with other components, or a Ca alloy into the molten steel, contained in a ladle, with the aid of a carrier gas. This is referred to as the injection method and a feature of this desulfurizing method resides in utilizing an intense reaction between the slag and the molten steel brought about by an intense stirring thereof due to the injection. The desulfurization method which is based on the reaction between the slag and the molten steel under intense stirring, contains drawbacks in that rephosphorization from the ladle slag is likely to occur during the treatment, and further, that the recovery rate of the alloying components, such as Al alloy, contained in the desulfurizing agent becomes low. Furthermore, the temperature fall of molten steel during the treatment is relatively great, and non-agitation of the bath level surface cannot be maintained due to the intense stirring; with the result that the molten steel inevitably absorbs the gas components, such as H, N, and the like, from the ambient air or slag. Therefore, when low nitrogen steels or steels required to have both low H and N contents, as in steels for use as plates, are to be melted, the steels subjected to the injection method must be again subjected to a degassing process, such as an RH or DH process. The additional process such as an RH or DH process leads to a further temperature fall of the molten steel. The molten steel must therefore be super-heated in a converter or the like, to compensate for the temperature fall during the additional process. Thus, an increase in the treating time of molten steel in a converter or the like inevitably occurs due to the super heating. In addition, the qualities of the molten steel are frequently unfavorably influenced by the super heating.

In order to eliminate the drawbacks as described above, a simultaneous degassing and desulfurizing method has been recently developed, according to which method a desulfurizing agent is injected together with the carrier gas into the upward stream of the molten steel within a vacuum vessel. Among the proposed methods, the method proposed by the present applicant in Japanese Unexamined Patent Publication No. 60-59011 discloses a method of producing with a small unit weight of the treating agent, molten steels having an ultra low sulfur content and having low N, O and H contents. In this method, a desulfurizing agent is added to the molten steel and a predominant desulfurizing reaction is completed in the steel bath having slag thereon, while the slag is essentially not stirred or caused to fluidize due to the addition of the desulfurizing agent. The above-mentioned molten steels having an ultra low sulfur content and low N, O, and H can be produced by using a treating agent containing at least 20%, preferably 40%, by weight of $CaF_2$, and containing CaO as the remaining main component.

The present inventors carried out a further study of the method disclosed in Japanese Unexamined Patent Publication No. 60-59011 and discovered the following problems involved therein.

(1) The desulfurizing agent used in Japanese Unexamined Patent Publication No. 60-59011 has a high desulfurization ability, but due to the high $CaF_2$ content of 20% by weight or more, promotes the erosion of the MgO-containing basic refractories generally used for the reaction vessel for molten steel. Such refractories are formed by using magnesia, magnesia-carbon, magnesia-chrome, or dolomite, spinel, alone or in mixture. Accordingly, when ultra low sulfur steels are frequently treated in such a refining vessel, the life of the vessel is shortened and the refractory cost is increased.

(2) When the desulfurization method disclosed in Japanese Unexamined Patent Publication No. 60-59011 is applied for molten steels having a relatively high quantity of inclusions, the treating agent injected into the molten steel and the oxide-based inclusions of molten steel coagulate and incorporate with one another, with the result that $Al_2O_3$ and the like are absorbed into the treating agent. Since the desulfurization ability is lessened due to such absorption, the treating agent containing a high $CaF_2$ concentration must be injected at a high unit weight per quantity of molten steel, when ultra-low steels having S content $<5$ ppm are to be obtained. This also leads to a shortening of the life of the reaction vessel and to an increase in the refractory cost.

As described above, according to the method of this publication, the slag on the bath level essentially is not stirred or fluidized, and therefore, engulfing of slag in the ladle and ambient air into the molten steel can be advantageously suppressed. Nevertheless, where the treating agent having a high $CaF_2$ concentration is injected at a great quantity so as to produce the ultra-low sulfur steels, the treating agent having a high $CaF_2$ concentration accumulates beneath the ladle slag, so that the melting point of the slag is considerably lowered, and hence the slag becomes completely molten up to the top surface thereof. In this case, the oxygen in the entire slag is easily moved, and hence the oxygen is liable to pass from the slag into the molten steel. Furthermore, when the casting process is carried out after the treating process, the slag as mentioned above is liable to be engulfed in the molten steel due to a swirl formed in the pouring stream when pouring into a tundish or a mold, and cause the inclusions to form.

Accordingly, a novel process which attains both an effective desulfurization and a decrease in the inclusions, must be developed.

SUMMARY OF THE INVENTION

The present invention eliminates the drawbacks involved in the conventional desulfurization treatments and provides an effective and economic desulfurizing means, in which the erosion of the basic refractory mainly composed of MgO is suppressed to as low a level as possible, and, the ability of a treating agent for decreasing S content is not impaired. The desulfurizing means (hereinafter referred to as the first treating agent) is characterized in that a first treating agent consists of CaO, $CaF_2$, MgO, and unavoidable impurities, contains from 10 to 60% by weight of MgO, and has a weight ratio of $\{(\%CaF_2)/((\%CaO)+(\%CaF_2))\}\times 100(\%)$ of from 20 to 80%.

A second treating agent for decreasing the inclusions is mainly composed of $CaF_2$ and CaO, additionally contains unavoidable impurities, and has a $CaF_2$ concentration based on the main components of 20% by weight or less.

The first or second treating agent is injected into molten steel while a reaction between this agent and the ladle slag is essentially prevented.

The unavoidable impurities of the first and second treating agents according to the present invention are usually $Al_2O_3$ and $SiO_2$, and the content of each impurity is preferably 3% by weight or less. $Al_2O_3$ and $SiO_2$ are examples of the impurities unavoidably incorporated into the treating agents under the present techniques. Their non-clusion is mort desirable in the light of reaction theory, but it not attend.

DESCRIPTION OF THE PREFERRED EMBODIMENTS

Figure 1A:
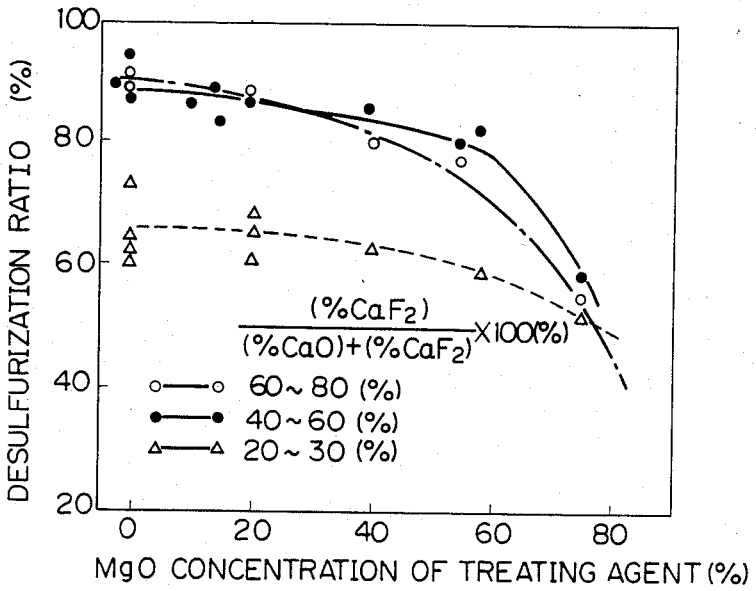
FIG. 1(A) is a graph showing, with parameters of weight ratio $\{(\%CaF_2)/((\%CaO)+(\%CaF_2))\}\times 100(\%)$, a dependence of the desulfurization ratio upon the MgO concentration and the weight ratio $\{(\%CaF_2)/((\%CaO)+(\%CaF_2))\}$.

The first treating agent attains a desulfurization ratio of approximately 60% or more, as shown in FIG. 1(A). This desulfurization ratio is attained by adding the first treating agent to the bath of molten steel, having no slag present thereon before injection. Therefore, a high desulfurization ratio of approximately 60% or more is attained under a condition that no slag except for the first treating agent is present during the treatment. As apparent from FIG. 1(A), the desulfurization ratio is reduced in accordance with an increase in the MgO concentration of the first treating agent, but this reduction in the desulfurization ratio is slight when the MgO concentration is as high as 60%. The dependence of the desulfurization ratio upon the $CaF_2$ concentration, as disclosed in Japanese Unexamined Patent Publication No. 60-59011, is advantageously maintained, as long as the MgO concentration is 60% by weight or less. That is, a high desulfurization ratio of 70% or more is attained, as long as the MgO concentration is 60% by weight or less, dependent upon the weight ratio of $\{(\%CaF_2)/((\%CaO)+(\%CaF_2))\}\times 100\geqq 40(\%)$.

Figure 1B:
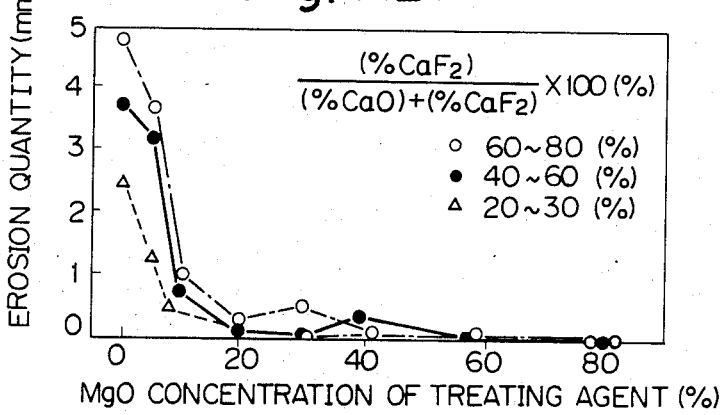
FIG. 1(B) is a graph showing a dependence of erosion quantity of a MgO-based basic refractory material upon the MgO concentration and the weight ratio $\{(\%CaF_2)/((\%CaO)+(\%CaF_2))\}$ of the CaO - $CaF_2$ based treating agent.

Referring to FIG. 1(B), the results of erosion tests are shown. In these tests, an MgO-$Cr_2O_3$ based refractory rod 10 mm in diameter was dipped for 10 minutes, in the bath of the treating agent having the weight ratio $\{(\%CaF_2)/((\%CaO)+(\%CaF_2))\}\times 100(\%)$ in the range of from 20 to 80(%) and an MgO concentration in range shown in the abscissa of FIG. 1(B). After dipping for 10 minutes, the maximum erosion quantity of the refractory rod was measured, and the result is given in FIG. 1(B). As apparent from FIG. 1(B), the erosion quantity becomes very small at the MgO concentration of 10% by weight or more, particularly 20% by weight or more, in any case where the weight ratio was $\{(\%CaO)/((\%CaO)+(\%CaF_2))\}$60–80%, 40–60% or 20–30%.

Figure 3A:
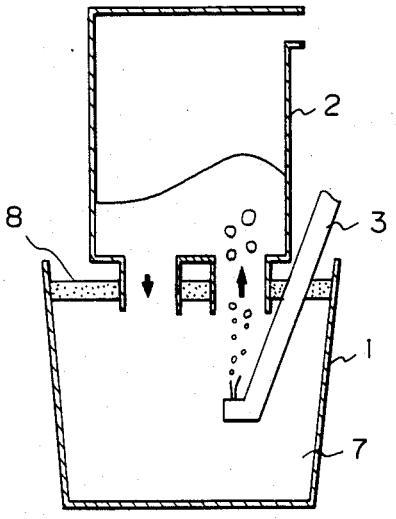
FIGS. 3(A) and (B) are cross sectional views of the apparatuses used in Examples A~D, BB, BC, and E through J as well as Comparative Examples E~J and Conventional Example K.

As shown in FIGS. 3(A) and (B), the carrier gas is injected into the bath, floats in the bath, and arrives at a portion of the bath surface which is kept within a reduced pressure-or inert gas-atmosphere and which is essentially free of slag. The desulfurizing reaction, therefore, can be carried out in an environment or atmosphere, to which it is difficult for the slag on the molten steel in the ladle to exert an influence. The carrier gas used in the present invention is Ar gas or any other inert gas. The environment or atmosphere mentioned above indicates the interior of the molten steel bath where the reactions of the first treating agent occur. Contrary to this, in the conventional stirring vessel for desulfurization shown in FIG. 8, an intense direct reaction between the molten steel and the slag, which is present on the molten steel contained in a ladle and is mixed with a desulfurizing agent is necessary for desulfurization. Since such a slag-metal reaction is not necessary in the present invention, the rephosphorization from the ladle slag due to stirring or fluidizing of slag does not occur, and resulfurization, which may occur after the treatment due to stirring or flowing of slag, essentially does not occur. In addition, according to the conventional desulfurization method, any slag, present on the molten steel bath prior to desulfurization, must be removed or modified prior to desulfurization in order to obtain ultra low sulfur steels. The treating cost of the molten steel, therefore, can be considerably reduced according to the present invention. Since a large amount of $CaF_2$ is used in the present invention, an erosion of the refractory of a ladle is anticipated. However, such erosion is mitigated to such a degree that it is not serious, because the reaction efficiency is so enhanced that the fundamental desulfurization reactions are completed within the molten steel, and because the unit weight of the desulfurizing treating agent is drastically reduced, and further, because the slag line does not move upward or downward.

The ladle used for treating the molten steel according to the present invention does not need a basic lining for promoting the desulfurization ability thereof, and therefore, the refractory cost of a ladle can be greatly reduced.

According to the present invention, the molten steel is stirred by the carrier gas of the first treating agent, while not essentially stirring the ladle slag. The reaction between the first treating agent and the molten steel occurs, during the stirring, under a certain environment, and it is difficult for the slag on the bath of molten steel to exert influence thereon. Accordingly, essentially speaking, a passage of oxygen from the ladle slag to the molten steel does not substantially occur, and the ladle slag is not engulfed in the molten steel to any noticeable extent. The cleanness of the molten steel, therefore, is little impaired. Nevertheless, when a great unit weight of the first treating agent having a high $CaF_2$ concentration is used for melting ultra-low sulfur steels, the first treating agent having a high $CaF_2$ concentration accumulates in a great quantity beneath the bottom surface of the ladle slag, thereby considerably lowering the melting point of the slag. In this case, the entire slag may become molten up to the top surface thereof, with the result that movement of the oxygen becomes easy, and hence the oxygen is liable to pass from the slag to the molten steel as described hereinabove. Furthermore, when the casting process is carried out after the treating process, the slag as mentioned above is liable to be engulfed in the molten steel due to a swirl formed in the pouring stream when pouring into a tundish or a mold, and cause the inclusions to form. In addition, when the desulfurization method described above is applied for molten steels having a relatively high quantity of inclusions, the treating agent injected into the molten steel and the oxide-based inclusions of molten steel coagulate and incorporate with one another, with the result that $Al_2O_3$ and the like are absorbed into the treating agent and the desulfurization ability of the first treating agent is detrimentally lessened.

The second treating agent according to the present invention eliminates the above described drawbacks against producing extremely clean steels, and attains an extreme cleanness of the molten steel while maintaining an effective desulfurization to an ultra low level of sulfur.

A method for treating molten steel proposed by the present invention comprises desulfurizing the molten steel in a reaction vessel which is lined with a basic refractory containing MgO, and is characterized in that the first treating agent, which consists of CaO, $CaF_2$, MgO, and unavoidable impurities, containing from 10 to 60% by weight of MgO, and having a weight ratio of $\{(\%CaF_2)/((\%CaO)+(\%CaF_2))\}\times 100(\%)$ of from 20 to 80%, is injected into the molten steel with the aid of an inert carrier gas, a reduced pressure-or inert gas-atmosphere is maintained above a portion of the bath surface of the molten steel, toward which portion the inert carrier gas floats and at which the inert carrier gas arrives, and further, that portion of the bath surface is essentially free of any slag which may be present on the steel bath before the treatment.

Another method for treating the molten steel according to the present invention comprises, prior to or subsequent to the desulfurization by the first treating agent, subjecting the molten steel in the reaction vessel to a treatment by the second treating agent which is mainly composed of $CaF_2$ and CaO, and additionally, contains unavoidable impurities and has a $CaF_2$ concentration based on the main components of 20% by weight or less, and further, the second treating agent is injected into the molten steel with the aid of an inert carrier gas, a reduced-pressure- or inert gas-atmosphere is maintained above a portion of the bath surface of the molten steel, toward which portion the inert carrier gas floats and at which the carrier gas arrives, and further, that portion of the bath surface is essentially free of slag before the first treatment by the first or second treating agent.

Figure 2:
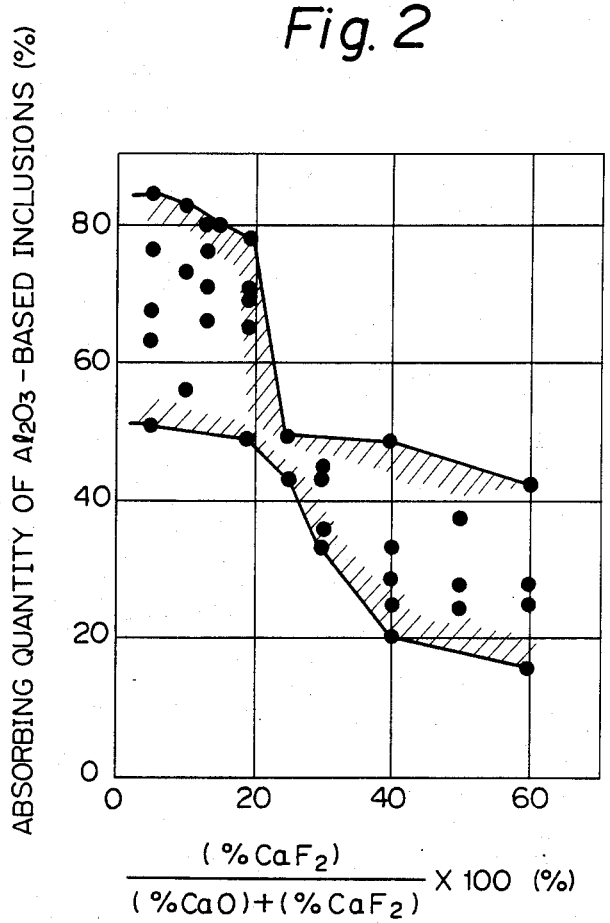
FIG. 2 is a graph showing a relationship between the absorbing quantity of $Al_2O_3$-based inclusions into the treating agent and the $CaF_2$ concentration of the CaO-$CaF_2$ based treating agent.

FIG. 2 shows how the absorbing quantity of $Al_2O_3$-based inclusions in the CaO-$CaF_2$ based treating agent is influenced by the proportion of CaO to $CaF_2$ in this agent, which is injected into the molten steel. As apparent from FIG. 2, when the weight ratio of $\{(\%CaF_2)/((\%CaO)+(\%CaF_2))\}\times 100(\%)\leqq 20$, the $Al_2O_3$ based inclusions can be absorbed in the CaO-$CaF_2$ based inclusions in an extremely great quantity. Although FIG. 2 shows a tendency to absorb $Al_2O_3$-based inclusions, virtually the same tendency exists for other inclusions. The inclusions include those in the form of a cluster and the $Al_2O_3$-based inclusions, which have a high melting point and assume a non-spheroidal shape in the stationary bath. These inclusions float only with difficulty but, once they are absorbed into the second treating agent, they become molten and the shape of the $Al_2O_3$ based inclusions is changed in that they assume a spheroidal form in a stationary bath. The spheroidal or molten inclusions float easily, and hence the inclusions in the molten steel are decreased.

The FeO based inclusions, the FeO-MnO based inclusions, and the $SiO_2$-MnO based inclusions are present in the molten steel before the steel is deoxidized with Al. These inclusions assume a spheroidal shape in the stationary bath, and their melting point is low, but, float only with difficulty due to their high specific gravity and good wettability with molten steel. The second treating agent according to the present invention and the inclusions having a high specific gravity coagulate together, so that the apparent specific gravity of the inclusions is lessened, and, further the wettability of inclusions with molten steel is lessened, thereby promoting their ability to float.

In accordance with the present invention, the injection of the second treating agent is carried out in such a manner that: any slag present on the bath level is not engulfed in the bath of molten steel; and the molten steel is not stirred or caused to flow by the injecting.

In the method illustrated in FIG. 3(A), the molten steel is circulated through a passage, which region is formed in a reduced-pressure chamber. In the method illustrated in FIG. 3(B), the molten steel is circulated through a passage, which region is formed in an inert-gas chamber. The carrier gas injected or the gas to promote the floating of the inclusions through the bath and arrives at that portion. A reducing pressureor inert gas-atmosphere is maintained at the top surface of the molten steel in this portion.

In addition, any slag formed before the first treatment is not present on the bath of molten steel at this portion. Since, according to the conventional method illustrated in FIG. 8, the carrier gas is injected toward the ladle slag present on the molten steel bath, the slag is engulfed in the molten steel, with the result that the inclusions in the bath of molten steel may be removed but the slag present on and then engulfed in other the bath of molten steel detrimentally causes the formation of inclusions. This is avoided in the present invention, as is understood from the above descriptions.

The second treating agent is injected in and picks up the inclusions is present between the bottom surface of the slag layer and the top surface of the molten steel bath, shielding the latter from the former, in such a manner that the interface reaction between the slag layer (which has an oxidizing property), and the molten steel is blocked, thereby preventing undesirable oxidation of Al and Si from occurring in the molten steel. Because of this shielding effect, the oxygen-feed or intrusion from the slag to the bath is prevented at a considerably lower unit weight of the treating agent than in conventional methods, and further, the effect of absorbing inclusions by the second treating agent is not impeded by the oxygen-feed or intrusion.

The inclusions present in the bath of molten steel, which are exclusively spheroidal, easily float, and the clusters and non-spheroidal impurities are left as traces in the bath of molten steel, according to the present invention. The spheroidal inclusions are decreased due to the floatation, until the casting step, to a level which has virtually no detrimental effect on the properties of the products.

In a method according to the present invention, the second treating agent is injected prior to or subsequent to the injecting of the first treating agent.

The method, in which the second and then first treating agents are added to the molten steel, is first described. In this method, the CaO and $CaF_2$ (20% by weight or less) components of the second treating agent decrease the inclusions, such as $Al_2O_3$, and then the first treating agent is injected into the molten steel in which the quantity of inclusions is small. Accordingly, the absorption of $Al_2O_3$ and the other inclusions into the first treating agent is mitigated. When the first treating agent absorbs the inclusions, such as $Al_2O_3$ and the like, the desulfurization reaction between the first treating agent and S is impeded. In the present invention, since the $Al_2O_3$ and the like are decreased before adding the first treating agent, the first treating agent is not absorbed by such inclusions and the desulfurization reaction is highly efficient. Since the second treating agent has a low $CaF_2$ concentration and a high melting point, it does not considerably lower the melting point of a slag, even if the second treating agent accumulates beneath slag present on the bath level prior to the treatment by the first treating agent. When the first treating agent injected subsequently contains a high concentration of $CaF_2$ and is used in a large amount, the oxygen is liable to intrude into the melt from the slag which becomes molten by the first treating agent. Nevertheless, since the second treating agent effectively enchances the melting point of the slag, the oxygen intrusion is unlikely to occur.

Next, the method, wherein the first and then second treating agents are added, is described.

The first treating agent is effective for desulfurization and also for decreasing the inclusions by absorbing them thereinto. However, the $Al_2O_3$ based inclusions contained cannot be thoroughly removed from the bath by means of only the first treating agent, namely, both first and then second treating agent must be used. In this case, the quantity of $Al_2O_3$-based inclusions becomes essentially zero, because of the $Al_2O_3$-absorbing effect of the second treating agent as shown in FIG. 2. In addition, when only the first treating agent is added to the steel, a slag formed due to the reaction of the first treating agent has a low melting point and is liable to be engulfed in the swirl of a pouring stream when the molten steel is poured into a tundish or a mold. Contrary to this, when the first and then second treating agents are added, the second treating agent, which has a high melting point, can be interposed beneath the slag, the melting point of which has been lowered by the first treating agent, and over the molten steel bath, and hence the slag is unlikely to be engulfed in the molten steel, and hence, inclusions are unlikely to form due to the engulfed slag.

The second treating agent promotes the floatation of inclusions and their separation from the bath of molten steel as described above. This is realized by making the non-spheroidal inclusions, which float with difficultly, spheroidal, and by decreasing the apparent density of inclusions having a high density and hence decreasing the wettability of the inclusions.

The floatation and separation of inclusions, particularly spheroidal inclusions, as described above are further promoted, when, after injecting of the second treating agent, inert gas is injected into the molten steel in such a manner that the slag formed due to reactions of the second treating agent, and occasionally, the first treating agent, is essentially not engulfed in the molten steel. The injecting of inert gas causes an intense stirring of molten steel. Due to such stirring, the coagulation and incorporation of spheroidal inclusions are promoted, and the gas injected in adheres on or within the spheroidal inclusions having a low melting point and decreases their apparent density, and as a result, the spheroidal inclusions are caused to float. This floatation effect is not appreciable for the $Al_2O_3$ clusters. In order to decrease the total of inclusions, including the $Al_2O_3$ clusters, the second treating agent must be injected prior to or subsequent to the injecting of the first treating agent to absorb the $Al_2O_3$ clusters into the second treating agent and to make the non-spheroidal inclusions spheroidal, and subsequently, the inert gas must be injected. Alternatively, the first treating agent may be injected to desulfurize, and subsequently, the inert gas may be injected. In this case, non-spheroidal inclusions and $Al_2O_3$ clusters may remain in the bath of molten steel, since the first treating agent having a high $CaF_2$ concentration cannot completely absorb the inclusions. The remaining inclusions are decreased by injecting the inert gas.

Figure 8:
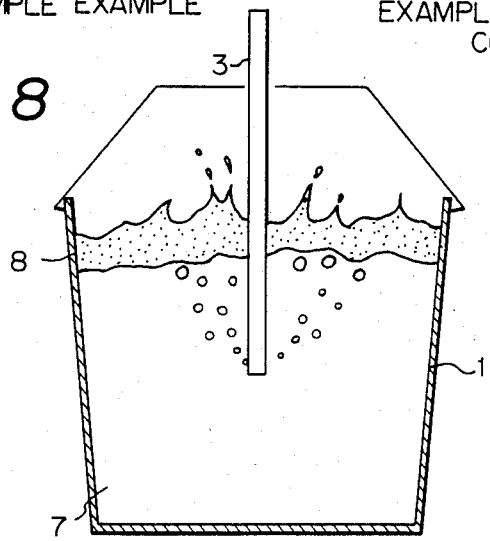
FIG. 8 is a cross sectional view of a conventionally widely-used desulfurizing reaction vessel, in which the slag in the ladle on the bath level is stirred for desulfurizing.

Referring to FIG. 8, which illustrates a conventional method, in which the injected gas stirs the slag 8 on the bath level of the molten steel, and the slag is then engulfed in the bath of molten steel. In this case, the inclusions in the bath of molten steel tend to increase.

The injecting rate of inert gas according to the present invention is determined so as not to essentially engulf the slag.

In addition, the molten steel is circulated along a passage of the reaction vessel, a part of which is maintained at a reducing-pressure or inert gas-atmosphere, thereby preventing oxygen from intruding from the ambient air into the molten steel, and effectively decreasing the inclusions. In addition, the degassing and decarburization reactions proceed in such a vessel, so that the N, H, and carbon contents can be lessened.

Note, the effects of desulfurization, and the decrease of inclusions are not dependent upon the MgO lining, and therefore, these effects can be attained even when using a reaction vessel in which the lining is free of MgO.

The first and second treating agents can be prepared by mixing, sintering, or premelting the respective components CaO, $CaF_2$, and MgO.

As described above, and described in more detail in the examples, the first treating agent according to the present invention consists of CaO, $CaF_2$, MgO, and unavoidable impurities, contains from 10 to 60% by weight of MgO, and has a weight ratio of $\{(\%CaF_2)/((\%CaO)+(\%CaF_2))\}\times 100(\%)=20\sim 80(\%)$, and therefore, in the treating agent according to the present invention, the excellent desulfurization characteristics of CaO- $CaF_2$-based treating agents are not impaired, and drawbacks, such as the erosion of a refractory reaction vessel occurring in the case of using treating agents with a high $CaF_2$ concentration, are prevented. Accordingly, it is possible to effectively prevent an increase in the refractory cost which can occur when the molten steel is continuously desulfurized in a large amount. As a result, the life of a reaction vessel is not shortened, and hence the production costs of steels are considerably lessened.

In accordance with the present invention, the treating agents are injected into the bath in such a manner that the slag present on the molten steel in a ladle is essentially not stirred until the completion of the desulfurization. Accordingly, it is not necessary to utilize an intense slag-metal reaction for the desulfurization, as in the conventional method. This enables the production of ultra-low sulfur steels at a small unit amount of desulfurizing agent and in a short period of time. Such a production process is advantageous in that it promotes a decrease in the temperature of the molten steels, and saves raw materials and energy.

In addition, according to the present invention, any slag present on the surface of molten steel bath before the treatments according to the present invention is not engulfed in the molten steel bath. In order to avoid any interface reaction between such slag and molten steel, through which the refining agent is injected, the carrier gas of the refining agent or the gas for promoting the floating of the treating agent is injected through the molten steel bath in such a manner that the top surface of bath, where the carrier gas or the like arrives, is essentially free of such slag. The second treating agent for decreasing the inclusions has a weight proportion of $\{(\%CaF_2)/((\%CaO)+(\%CaF_2))\}\times 100(\%)\leqq 20(\%)$ which is favourable for causing the inclusions to float. The treating agent for decreasing the inclusions is injected prior to and/or subsequent to the desulfurizing (first) treating agent.

By injecting the CaO-$CaF_2$ based (second) treating agent prior to or subsequent to injecting of the desulfurizing (first) treating agent as described above, desulfurization and a decrease in the inclusions are attained.

The inclusions are decreased quickly and economically to a level not detrimental to the application of steel products. The desulfurization becomes effective, since inclusions do not coagulate in the desulfurizing agent, and hence the desulfurizing ability of the desulfurizing (first) treating agent is not deteriorated due to the coagulation.

In accordance with an embodiment of the present invention, after injecting all of the treating agents, the inert gas is injected in such a manner that any slag on the bath level is essentially not engulfed in the steel, thereby drastically promoting the absorbing of the inclusions in the treating agents, and the coagulation and floating of the inclusions.

In accordance with an embodiment of the present invention, the molten steel is degassed while it is subjected to treatment for both desulfurization and decreasing the inclusions. Thus a simultaneous degassing and decrease in the inclusions or desulfurization is attained. The reactions occur in the present invention in a vacuum-degassing vessel, such as an RH or DH vessel, or a vessel having an inert gas atmosphere. These vessels enable the implementation of incidental degassing, which then attains a simplification of the treatment processes by unifying the treatment steps. Therefore, the cost is greatly reduced, and the production yield is greatly enhanced.

EXAMPLES

The present invention is hereinafter explained in detail by way of examples with reference to Tables 1 through 10, FIGS. 3(A) and (B), and FIGS. 4 through 7.

In Table 1, the desulfurizing of Examples A~D, and Comparative Examples E~K, in which only the desulfurizing treatment cycle is carried out, is described.

The treatment cycles given in Table 4 are:

Example CA-decrease of inclusions-desulfurizing;

Example CB-decrease of inclusions-desulfurizing-injecting of inert gas;

Example CC-desulfurizing-decrease of inclusions; and,

Example CD-desulfurizing-decrease of inclusions-injecting of inert gas. The treating agents and conditions for injecting the treating agents and inert gas are given in Table 4.

The treatment cycles given in Table 7 are:

Example AA-decrease of inclusions-desulfurizing-decrease of inclusions; and,

Example AB decrease of inclusions-desulfurizing-decrease of inclusions-injecting of inert gas. The treating agents and conditions for injecting the treating agents and inert gas are given in Table 7.

The treatment cycle given in Table 9 is the desulfurizing and inert gas-injecting cycle. The treating agent and conditions for injecting the treating agent and the inert gas are shown in Table 9.

Figure 3B:
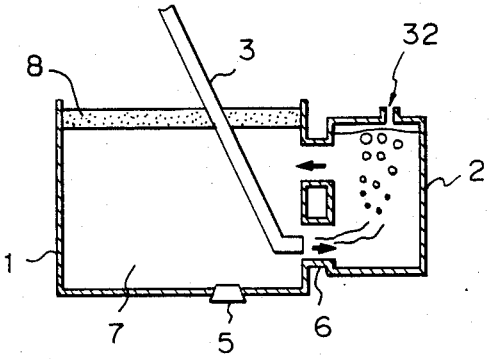

In Examples A through D, apparatuses as shown in FIGS. 3(A) and (B) were used. These apparatuses consist of a ladle 1, a reaction vessel 2, and an injection lance 3. The molten steel treated in the apparatus is denoted by 7, and the slag is denoted by 8. The reaction vessel 2 shown in FIG. 3(A) is a degassing reactor under reduced pressure, and the reaction vessel 2 shown in FIG. 3(B) is a reactor communicated with ambient air. In the space above the bath level of reaction vessels in both drawings, an inert gas atmosphere is satisfactorily maintained.

In addition, essentially no slag 8 is present on the bath level of reaction vessels in both drawings. The tapping hole is denoted by 5, and the passage is denoted by 6.

In Comparative Examples E~J, the apparatuses shown in FIGS. 3(A) and (B) were used, with the same injecting conditions of treating agents as in Examples A~D. The treating agents used in Comparative Examples E, F, and G contained inevitably up to 2% by weight of MgO.

Besides Comparative Examples E~J, a conventional treatment method by merely degassing and without any treating agents was carried out, using the apparatus shown in FIG. 3(A). This is referred to as Conventional Example K.

The refractory material of the reaction vessel 2 is $MgO\text{-}Cr_2O_3$ based material having an MgO content of 74% by weight and containing inevitably $SiO_2$ and $Al_2O_3$. This material is that generally used in the plants for treating the molten steel.

In Examples A, B, C, and D as well as Comparative Examples E, F, G, J, and Conventional Example K, the erosion amount of the refractories was measured after treating, in each example, one hundred charges of molten steels which had compositions ranging from 0.08 to 0.1% by weight of C, from 0.18 to 0.22% by weight of Si, from 0.9 to 1.2% by weight of Mn, and from 0.02 to 0.05% by weight of Al. The compositions varied within these ranges between prior to and subsequent to the treatments. The position of the reaction vessel, at which the erosion amount was measured, was in the neighborhood of the refractory lining, where the bath level was during treatments.

In the examples and comparative examples, the unit weight of the treating agent per ton of molten steel was 2.5–3.0 kg/ton for each example and comparative example. The S content of molten steel before and after the treatments as well as the desulfurization ratio are shown in Table 2. These values are representative of one hundred charges of each example. Table 3 shows the maximum erosion amount of the hundred charges, i.e., the erosion amount per treatment when the refractory lining was eroded to the greatest extent by the melt.

As is apparent from Table 2, the desulfurization ratio attained by the first treating agent in an unit amount of from 2.5 to 3.0 kg/ton of molten steel is more than 60% in all Examples A through D, and the S content attained by such treating agent is less than 12 ppm. Particularly in Examples B, C, and D, in which the $\{(\%CaF_2)/((\%CaO)+(\%CaF_2))\}\times 100(\%)\geqq 40\%$, desulfurization ratio is more than 83%, which results in attaining an ultra-low sulfur steel having S content of from 3 to 5 ppm. In addition to the outstanding desulfurizing effect attained in Examples B, C, and D, the maximum erosion amount per charge is from 0.4 to 0.7 mm, which is approximately the same as that of Conventional Example K without injecting the treating agent. Contrary to this, in Comparative Examples E, F, and G, the desulfurization ratio is the approximately the same as in the examples and approximately the same S content as in the examples is attained. Nevertheless, as is apparent from Table 3, the maximum erosion amount is more than 1.1 mm in Comparative Examples E, F, G, and J. This is more than twice, that is, less than a half of the refractory life, of Conventional Example K, in which the treating agent is not added. As is apparent from Table 2, the desulfurization ratio is 55% or less in Comparative Examples H, I, and J, and in Conventional Example K. Especially, in Comparative Example H and J and Conventional Example K, in which the treating agent is not added, the desulfurization ratio is 10% at the highest, and the S content attained after treatment is merely from 27 to 30 ppm.

TABLE 1

| | | | $\frac{(\%\ CaF_2)}{(\%\ CaO)+(\%\ CaF_2)}\times 100(\%)$ | MgO (wt %) |
|---|---|---|---|---|
| Composition of Treating Agent | Example | A | 25 | 20 |
| | | B | 40 | 20 |
| | | C | 45 | 10 |
| | | D | 70 | 40 |
| | Comparative Example | E | 25 | 0.2 |
| | | F | 42 | 2 |
| | | G | 70 | 1 |
| | | H | 15 | 30 |
| | | I | 45 | 70 |
| | | J | 89 | 30 |
| Unit Weight of Treating Agent | | | 2.5~3 kg/ton of molten steel | |
| Carrier Gas | | | Ar: 2000 Nl/min | |

TABLE 2

| | | FIG. 3(A) | | | FIG. 3(B) | | |
|---|---|---|---|---|---|---|---|
| | | S Content in Molten Steel (ppm) | | Desulfurization Ratio (%) | S Content in Molten Steel (ppm) | | Desulfurization Ratio (%) |
| | | Before Treatment | After Treatment | | Before Treatment | After Treatment | |
| Example | A | 31 | 12 | 61 | 29 | 11 | 62 |
| | B | 30 | 5 | 83 | 31 | 5 | 84 |
| | C | 28 | 3 | 89 | 28 | 4 | 86 |
| | D | 29 | 4 | 86 | 29 | 5 | 83 |
| | E | 32 | 11 | 66 | 30 | 12 | 60 |
| Comparative Example | F | 30 | 4 | 87 | 28 | 4 | 86 |
| | G | 28 | 3 | 89 | 27 | 3 | 89 |
| | H | 30 | 27 | 10 | 33 | 30 | 9 |
| | I | 28 | 14 | 51 | 33 | 15 | 55 |
| | J | 31 | 28 | 9.7 | 29 | 28 | 3 |

TABLE 2-continued

| | | FIG. 3(A) | | | FIG. 3(B) | | |
|---|---|---|---|---|---|---|---|
| | | S Content in Molten Steel (ppm) | | Desulfurization Ratio (%) | S Content in Molten Steel (ppm) | | Desulfurization Ratio (%) |
| | | Before Treatment | After Treatment | | Before Treatment | After Treatment | |
| Conventional Example | K | 30 | 30 | 0 | — | — | — |

TABLE 3

| | | Maximum Erosion of Reaction Vessel's Refractory per Treatment | |
|---|---|---|---|
| | | FIG. 3(A) Per Treatment (mm) | FIG. 3(B) Per Treatment (mm) |
| Example | A | 0.5 | 0.4 |
| | B | 0.6 | 0.4 |
| | C | 0.6 | 0.5 |
| | D | 0.7 | 0.6 |
| Comparative Example | E | 1.2 | 1.1 |
| | F | 1.7 | 1.5 |
| | G | 2.8 | 2.4 |
| | J | 2.5 | 2.5 |
| Conventional Example | K | 0.5 ~ 0.6 | — |

The lining of reaction vessels used in Examples A through D and made of refractory material containing 74% by weight of MgO is one of the refractory materials exhibiting the most drastic erosion. In addition to the lining mentioned above, more erosion resistant refractory materials containing 30% by weight of MgO, and 55% by weight of MgO, respectively, were used for the lining of the reaction vessels, and the same procedures as in Examples A through D were carried out. In the additional examples, improved results were attained of the desulfurization ratio exceeding 60%, and the wear amount of lining of the reaction vessels per treatment being 0.3 mm or less.

The examples given in Table 4 are now described. In Examples CA and CB, the $CaO-CaF_2$ based (second) treating agents $\{(\%CaF_2)/((\%CaO)+(\%CaF_2))\}\times 100(\%)=8$ and 14(%), respectively, were injected so as to decrease the inclusion in Treatment I. Subsequently, the $CaO-CaF_2-MgO$ based (first) treating agents having $\{(\%CaF_2)/((\%CaO)+(\%CaF_2))\}\times 100(\%)=45$ and 51(%), respectively, and containing MgO in the range of from 10 to 20% by weight, were injected so as to be desulfurized in Treatment II. In Examples CC and CD, the $CaO-CaF_2-MgO$ based (first) treating agents having $\{(\%CaF_2)/((\%CaO)+(\%CaF_2))\}\times 100(\%)=45$ and 51(%), respectively, and containing MgO in the range of from 10 to 20% by weight were injected to be desulfurized in Treatment I, and subsequently, the $CaO-CaF_2$ based (second) treating agents having $\{(\%CaF_2)/((\%CaO)+(\%CaF_2))\}\times 100(\%)=8(\%)$, and 14(%), respectively, were injected so as to decrease the inclusions in Treatment II. In Examples CB and CD, after completion of Treatments I and II, Ar gas was injected through the injection lance 3 at a flow rate of 1800 Nl/minute for 5 minutes.

In each example, the compositions of treating agents were changed, when Treatment I was completed, by supplying from the respective hoppers containing CaO, $Caf_2$, or MgO the portions of CaO, $CaF_2$, and MgO at an amount corresponding to the compositions of Treatment II. Between Treatments I and II, the composition of the treating agents and proportion of CaO to $CaF_2$ continuously varied from that in Treatment I to that in Treatment II. The molten steels treated in Examples CA, CB, CC, and CD had, as in Examples A through D, compositions ranging from 0.08 to 0.1% by weight of C, from 0.18 to 0.22% by weight of Si, from 0.9 to 1.2% by weight of Mn, and, from 0.02 to 0.05% by weight of Al. The compositions varied within these ranges between prior to and subsequent to the treatments.

The refractory material of the circulation vessel 2 was, as in Examples A ~ D, $MgO-Cr_2O_3$ based material having an MgO content of 74% by weight and containing inevitably $SiO_2$ and $Al_2O_3$.

In each example, fifty charges were treated.

Figure 4:
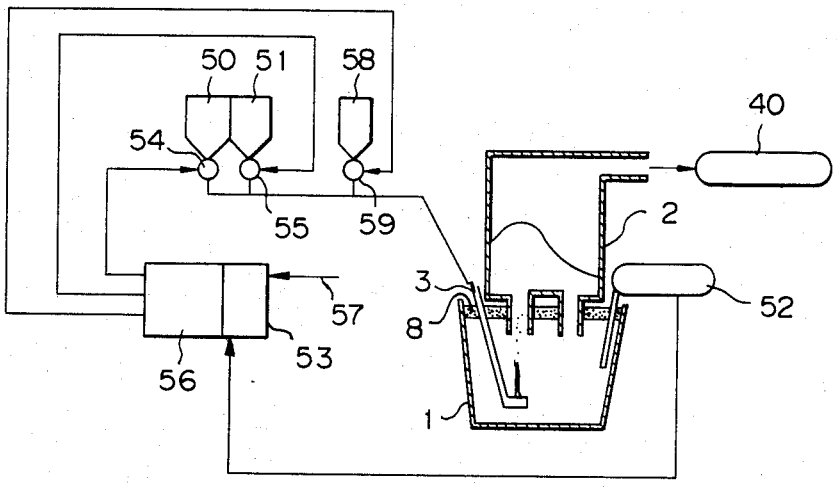
FIG. 4 illustrates an apparatus used in Examples CA through CD, AA, and AB.

The treatment apparatus is shown in FIG. 4 and comprises a hopper for MgO 58, a hopper for $CaF_2$ 50, a hopper for CaO 51, a sampling and analyzing device of molten steel 52, and a setting unit of pattern of treatment cycles 53, feeders 54, 55 and 59 for portioning $CaF_2$, CaO, and MgO, respectively. The set signal is denoted by 57. The signals from these members are input to the calculating and instructing unit 56. The signals of the MgO, $CaF_2$, and CaO amount input to the calculating and instructing unit 56 are compared, at every moment, with the pattern of treatment cycle set by the unit 53. The calculating and instructing unit 56 calculates the requisite proportion of $CaF_2$, CaO, and MgO and timing of adding them. From this timing a time for conveying them from the hoppers 50, 51, and 58 to the injection lance 3 is subtracted in the calculating and instructing unit 56, which then instructs the feeders 54, 55, and 59 to portion out the $CaF_2$, CaO, and MgO, respectively, contained in the hoppers.

Figure 5:
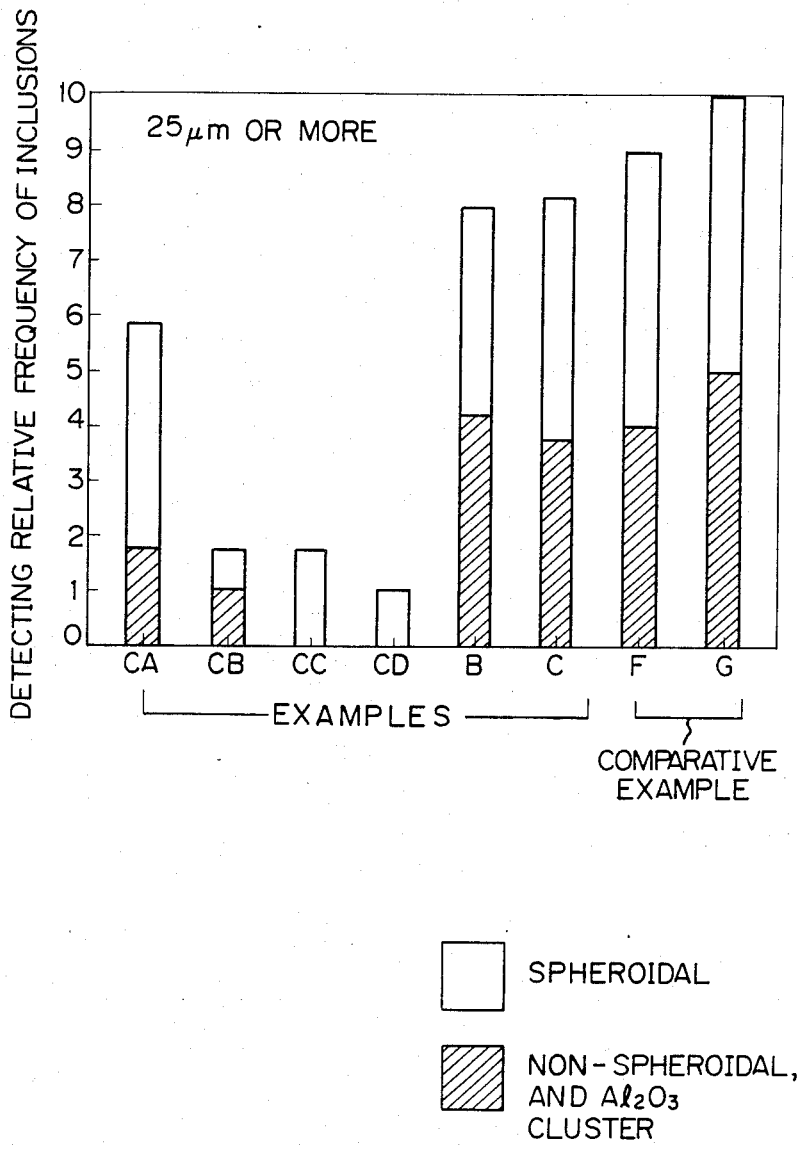
FIG. 5 is a graph showing the detecting relative frequency of inclusions after treatments in Examples B, C, CA through CD, and the Comparative Examples, which inclusions are classified into first group of spheroidal inclusions (blank columns) and second group of nonspheroidal inclusions and $Al_2O_3$ clusters (hatched columns) which float with difficulty.

In Table 5, the S content of molten steel before and after treatments, the desulfurization ratio, and the total oxygen content are shown. These values are representative of fifty charges of each example. In FIG. 5, the detecting relative frequency of inclusions 25 μm or greater in size is illustrated by classifying them into spheroidal inclusions, non-spheroidal inclusions, and $Al_2O_3$ clusters. Note in Table 5 and FIG. 5, the S content of molten steel before and after treatments, the desulfurization ratio, the total oxygen content, and a representative detecting relative frequency of inclusions are shown for Examples B and C, and Comparative Examples F and G. The detecting relative frequency of inclusions in FIG. 5 is a relative value based on the number of inclusions in Comparative Example G, which is expressed as 10.

As is apparent from Table 5, Examples CA and CD, in which the (second) treating agents for decreasing the inclusions were injected, followed by injecting the desulfurizing (first treating) agents, attain a lower S content of molten steel and higher desulfurization ratio than any of Examples B, C, and Comparative Examples F, G. As is apparent from Table 5 and FIG. 5, Examples CA, CB, CC, and CD attain a lower total oxygen content and a lower detecting relative frequency of inclusions than Examples B, C, F, and G. Particularly, by means of injecting the treating agent for decreasing the inclusions after the desulfurizing agent's injecting (Examples CC and CD), the detecting relative frequency of $Al_2O_3$ clusters 25 μm or greater in size is zero, which indicates an outstanding decreasing effect of the $Al_2O_3$-based inclusions. By injecting the Ar gas into the melt after injecting the treating agents (Examples CB and CD), the detecting relative frequency of the entire inclusions decreases.

Next, the examples given in Table 7 are described. In these examples, the apparatus shown in FIG. 4 was used. In Examples AA and AB, the treating agents containing 10% or less by weight of $CaF_2$ were injected prior to and subsequently to injecting the desulfurizing treating agents. In Example AB, after injecting of all of the treating agents, the Ar gas exclusively was injected through an injection lance 3 at a flow rate of 2000 Nl/minute for 5 minutes.

In each example, the compositions of the treating agents were changed, when the initial and subsequent half stages of Treatment I and Treatment II were successively replaced one after another, by feeding from the respective hoppers containing CaO, $CaF_2$, or MgO the portions of CaO, $CaF_2$ and MgO, at an amount corresponding to the compositions of subsequent treatments.

TABLE 4

| | | Treatment I Composition of Treating Agent | | | | | Treatment II Composition of Treating Agent | | |
|---|---|---|---|---|---|---|---|---|---|
| | | MgO (wt %) | CaO (wt %) | $CaF_2$ (wt %) | $\frac{(\% CaF_2)}{(\% CaO) + (\% CaF_2)} \times 100 (\%)$ | Treating Time (min) | MgO (wt %) | CaO (wt %) | CaF (wt %) |
| Example | CA | — | 88 | 8 | 8 | 8.5 | 15 | 45 | 36 |
| | CB | — | 83 | 13 | 14 | 9.0 | 20 | 37 | 39 |
| | CC | 10 | 47 | 39 | 45 | 8.5 | — | 88 | 8 |
| | CD | 11 | 41 | 41 | 50 | 8.5 | — | 83 | 13 |
| Injecting Rate of Treating Agent | | | | | | | | 100 kg/min | |
| Carrier Gas used when Injecting a Treating Agent | | | | | | | | Ar | |
| Flow Rate of Carrier Gas | | | | | | | | 1000 Nl/min | |
| Amount of Molten Steel | | | | | | | | 340 ton | |

| | | Treatment II Composition of Treating Agent | Ar Injecting after Injecting of Treating Agent | | |
|---|---|---|---|---|---|
| | | $\frac{(\% CaF_2)}{(\% CaO) + (\% CaF_2)} \times 100 (\%)$ | Treating Time (min) | Ar Flow Rate (Nl/min) | Injecting Time (min) |
| Example | CA | 45 | 8.5 | — | — |
| | CB | 51 | 9.0 | 1800 | 5 |
| | CC | 8 | 8.5 | — | — |
| | CD | 14 | 9.0 | 1800 | 5 |

TABLE 5

| | | S Content in Molten Steel (ppm) | | Desulfurization Ratio (%) | Total Oxygen Content (ppm) | |
|---|---|---|---|---|---|---|
| | | Before Treatment | After Treatment | | Before Treatment | After Treatment |
| Example | CA | 30 | 1 | 97 | 72 | 12 |
| | CB | 32 | 2 | 94 | 74 | 11 |
| | CC | 33 | 3 | 91 | 70 | 9 |
| | CD | 31 | 3 | 90 | 71 | 8 |
| Example | B | 30 | 5 | 83 | 76 | 18 |
| | C | 28 | 3 | 89 | 72 | 20 |
| Comparative | F | 30 | 4 | 87 | 72 | 20 |
| Example | G | 28 | 3 | 89 | 73 | 25 |

The maximum erosion quantity of the refractory material per charge was measured, during treating of fifty charges, at the vicinity where the bath level was located in the reaction vessel during treatment. The results are shown in Table 6.

TABLE 6

| Examples | Maximum erosion of reacion vessel's refractory per treatment (mm) |
|---|---|
| CA | 0.8 |
| CB | 0.8 |
| CC | 0.7 |
| CD | 0.8 |

As is apparent from Table 6, the erosion in each of Examples CA, CB, CC, and CD is lessened as compared with that of Comparative Examples E, F, G, and J. This means that the drawback of erosion involved in injecting the treating agent with a high $CaF_2$ concentration is mitigated.

Between successive treatments, the composition of treating agents and proportion of CaO to $CaF_2$ continuously varied. The components inevitably contained in the CaO-$CaF_2$ based (second) treating agents were 0.42% by weight of $Al_2O_3$, 3.04% by weight of $SiO_2$, and 0.43% by weight of MgO.

In Examples AA and AB, the molten steels were deoxidized and then subjected to Treatment I. The molten steels treated in Examples AA, and AB had compositions ranging from 0.08 to 0.15% by weight of C, from 0.15 to 0.23% by weight of Si, from 0.92% to 1.30% by weight of Mn, and, from 0.02 to 0.05% by weight of Al. The compositions varied within these ranges between prior to and subsequent to the treatments.

non-spheroidal inclusions nor $Al_2O_3$ clusters are detected.

TABLE 7

| | | Treatment I | | | | | | | |
|---|---|---|---|---|---|---|---|---|---|
| | | Initial Half Stage of Treatment I | | | Subsequent Half Stage of Treatment | | | | |
| | | Composition of Treating Agent | | | Composition of Treating Agent | | | | |
| | | CaO (wt %) | $CaF_2$ (wt %) | Treating Time (min) | MgO (wt %) | CaO (wt %) | $CaF_2$ (wt %) | $\frac{(\% CaF_2)}{(\% CaO) + (\% CaF_2)} \times 100$ (%) | Treating Time (min) |
| Example | AA | 93 | 5 | 5 | 15 | 45 | 36 | 45 | 8.5 |
| | AB | 92 | 4 | 5 | 10 | 52 | 34 | 40 | 9.0 |
| Injecting Rate of Treating Agent | | | | | | | | 100 kg/min | |
| Carrier gas used when Injecting a Treating Agent | | | | | | | | Ar | |
| Flow Rate of Carrier Gas | | | | | | | | 1000 Nl/min | |
| Amount of Molten Steel | | | | | | | | 340 tons | |

| | | Treatment II | | | Ar Injecting after Injecting of Treating Agent | |
|---|---|---|---|---|---|---|
| | | Composition of Treating Agent | | Treating | Ar Flow | Injecting |
| | | CaO (wt %) | $CaF_2$ (wt %) | Time (min) | Rate (Nl/min) | Time (min) |
| Example | AA | 90 | 10 | 3 | — | — |
| | AB | 90 | 10 | 3 | 2000 | 5 |

Figure 6:
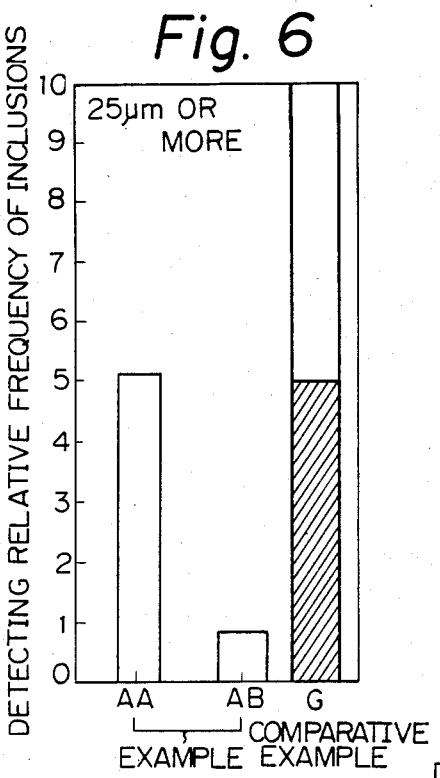
FIG. 6 is a graph showing the detecting relative frequency of inclusions after treatment in Examples AA and AB.

In Table 8, the S content of molten steel before and after treatments, and the total oxygen content are shown. These values are representative of fifty charges of each example. In FIG. 6, the generating frequency of inclusions 25 μm or greater in size is illustrated.

TABLE 8

| | S Content in Molten Steel (ppm) | | Total Oxygen Content (ppm) | |
|---|---|---|---|---|
| | Before Treatment | After Treatment | Before Treatment | After Treatment |
| AA | 32 | 2 | 70 | 9 |
| AB | 33 | 2 | 68 | 7 |

As is apparent from Table 8, the S content of molten steels after the treatments is 2 ppm, and the total oxygen content is from 7 to 9 ppm. The sulfur and oxygen contents are drastically reduced to yield ultra-low sulfur-high purity steels. In addition, as is apparent from FIG. 6, the detecting relative frequency of inclusions are extremely low. The detecting relative frequency of inclusions equal to one in Example AB indicates an outstanding effect. In Examples AA and AB, neither For the lining of the circulation passage 2 of reaction vessel used in Examples AA and AB, $MgO-Cr_2O_3$ based refractory material having MgO content of 55% by weight was used. This lining was eroded for 0.6 mm per charge at most, and hence, the treating agents exhibited improved results as compared with Comparative Examples E-J.

Next, the examples given in Table 9 are described.

The apparatus used in Examples BB and BC was, as in Examples A through D, the one illustrated in FIG. 3(A). As the treating agent the desulfurizing treating agent was exclusively injected, and subsequently, the molten steel was stirred with the aid of inert gas, while essentially not stirring or fluidizing the slag 8 in the bath. The injecting conditions of the desulfurizing treating agents in Examples BB and BC are the same as those given in Examples B and C, respectively. After injecting the desulfurizing treating agents, the Ar gas was injected through the injection lance 8 at a rate of 2500 Nl/min for 4 minutes.

Figure 7:
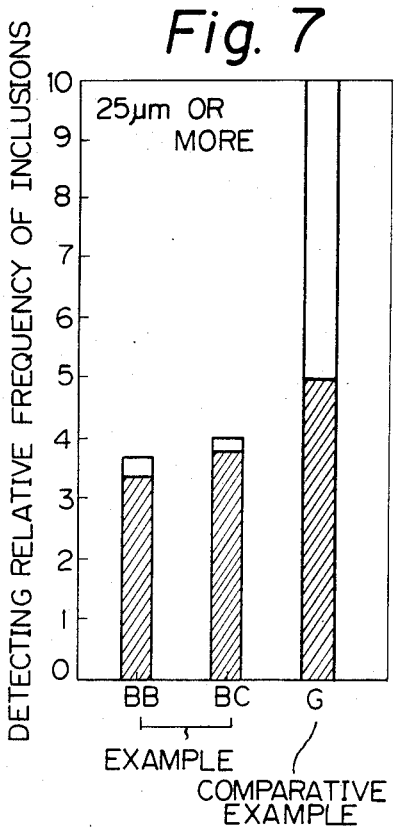
FIG. 7 is a graph showing the detecting relative frequency of inclusions after treatments in Examples BB and BC, which inclusions are classified into first group of spheroidal inclusions (blank columns) and second group of non-spheroidal inclusions and $Al_2O_3$ clusters (blank columns) which float with difficulty.

In Table 10, the S content of molten steel before and after treatments, the desulfurization ratio, and the total oxygen content are shown. In FIG. 7, the detecting relative frequency of the inclusions as a whole is illustrated.

TABLE 9

| | | Composition of Treating Agent | | | Ar Injecting after Injecting of Treating Agent | |
|---|---|---|---|---|---|---|
| | Test No. | $\frac{(\% CaF_2)}{(\% CaO) + (\% CaF_2)} \times 100$(%) | MgO (wt %) | | Ar Flow Rate (Nl/min) | Injecting Time (min) |
| Example | BB | 40 | 20 | | 2500 | 4 |
| | BC | 45 | 10 | | 2500 | 4 |
| Unit Weight of Treating Agent | | | 2.7 kg/ton of molten steel | | | |
| Carrier Gas | | | | | Ar: 2000 Nl/min | |

TABLE 10

| | Test No. | S Content in Molten Steel (ppm) Before Treatment | After Treatment | Desulfurization Ratio (%) | Total Oxygen Content (ppm) Before Treatment | After Treatment |
|---|---|---|---|---|---|---|
| Example | BB | 31 | 5 | 84 | 68 | 13 |
| | BC | 30 | 4 | 87 | 75 | 14 |

The desulfurization ratios in Examples BB and BC are virtually the same as those of B and C shown in Table 5, respectively. However, the total oxygen content after the treatments is lower than those in Examples B and C. As is apparent from FIGS. 7 and 5, the detecting relative frequencies of inclusions in Examples BB and BC are less than those in Examples B and C, respectively. The spheroidal inclusions are drastically decreased in Examples BB and BC, but the $Al_2O_3$ clusters in Examples BB and BC are in an amount virtually the same as in Examples B and C, respectively.

For the lining of the reaction vessel 2 used in Examples BB and BC $MgO\text{-}Cr_2O_3$ based refractory material having an MgO content of 74% by weight was used as in Examples A through D. The maximum erosion amount of the refractory material per charge was measured, after treating fifty charges, at the vicinity where the bath level was located during treatment. The lining was eroded by 0.7 mm at most, and hence, the treating agents exhibited considerably improved results as compared with Comparative Examples E-J.

We claim:

1. A method for treating molten steel, wherein it is desulfurized in a reaction vessel which is lined with a basic refractory containing MgO, characterized in that a desulfurizing treating agent, which consists essentially of CaO, $CaF_2$ and MgO and the balance consisting of unavoidable impurities, which treating agent contains from 10 to 60% by weight of MgO, and has a weight ratio of $((\%CaF_2)/((\%CaO)+(\%CaF_2)))\times 100(\%)$ of from 20 to 80%, is injected into a bath of the molten steel with the aid of an inert carrier gas; and a reduced pressure- or inert gas-atmosphere is kept above a portion of the bath surface of the molten steel, toward which portion the inert carrier gas floats and at which the inert carrier gas arrives, and, further said portion of the bath surface is essentially free of any slag which may be present in the steel bath during the treatment.

2. A method for treating molten steel according to claim 1, wherein prior to or subsequent to the desulfurization by said desulfurizing treating agent, or both prior and subsequent to the desulfurization by said desulfurizing treating agent, the molten steel is subjected in said reaction vessel to a treatment by an inclusion-reduction treating agent which is mainly composed of $CaF_2$ and CaO, and additionally contains unavoidable impurities and has a $CaF_2$ concentration based on the main components of 20% by weight or less, and further said inclusion-reduction treating agent is injected into the molten steel with the aid of an inert carrier gas, a reduced presure- or inert gas-atmosphere is kept above a portion of the bath surface of the molten steel, toward which portion the inert carrier gas floats and at which carrier gas arrives, and, further said portion of the bath surface is free of any slag when treated first either by said desulfurizing treating agent or inclusions-reduction treating agent.

3. A method for treating the molten steel according to claim 1, wherein subsequent to treatment by the desulfurizing treating agent, only an inert gas is injected into the molten steel contained in said reaction vessel in such a manner essentially not to stir or fluidize said any slag and any slag which is formed due to a reaction of the desulfurizing treating agent and which is present on the steel bath.

4. A method for treating the molten steel according to claim 2, wherein, subsequent to treatment by the desulfurizing agent and the inclusions-reduction treating agent, only an inert gas is injected into the molten steel contained in said reaction vessel so as not to stir or fluidize said any slag and any slag which may be present on the steel bath by the treatments by the desulfurizing treating agent and the inclusions-reduction treating agent and which are formed due to the reaction by these treating agents and are present on the steel bath.

* * * * *